United States Patent [19]

Meiller et al.

[11] Patent Number: 4,818,020

[45] Date of Patent: Apr. 4, 1989

[54] SEAT ADJUSTMENT APPARATUS

[75] Inventors: Hermann Meiller; Wolfram Jahn, both of Amberg, Fed. Rep. of Germany

[73] Assignee: Grammer Sitzsysteme GmbH, Fed. Rep. of Germany

[21] Appl. No.: 47,201

[22] Filed: May 6, 1987

[30] Foreign Application Priority Data

May 14, 1986 [DE] Fed. Rep. of Germany ..... 3616153

[51] Int. Cl.[4] ..... A47C 1/022

[52] U.S. Cl. ..... 297/313; 74/471 XY; 297/300

[58] Field of Search ..... 74/471 XY; 297/300, 297/313; 248/404, 157, 631

[56] References Cited

U.S. PATENT DOCUMENTS

| | | | |
|---|---|---|---|
| 1,822,082 | 9/1931 | Davis | 74/471 XY |
| 2,379,778 | 7/1945 | Allen | 74/471 XY |
| 3,788,587 | 1/1974 | Stemmler | 248/404 |
| 4,103,559 | 8/1978 | Kohler | 74/471 XY |
| 4,364,605 | 12/1982 | Meiller | 297/300 |
| 4,470,320 | 9/1984 | Kim | 74/471 XY |
| 4,521,053 | 6/1985 | Boer | 297/313 |
| 4,589,697 | 5/1986 | Bauer et al. | 297/300 |
| 4,603,905 | 8/1986 | Stucki | 297/300 |

*Primary Examiner*—Peter A. Aschenbrenner

*Attorney, Agent, or Firm*—Lerner, David, Littenberg, Krumholz & Mentlik

[57] ABSTRACT

A seat such as an office chair has at least two gas spring units for performing different functions such as adjusting the angles of inclination of the backrest portion and the seat portion of the chair. The gas spring units are operated by a common operating lever having an operating handle at one end while at its second end it is carried in a vertical slot so as to be pivotable in a horizontal direction about the vertical axis of the slot and slidable lengthwise of the slot. At a location spaced from its second end the lever is mounted in a horizontal slot so as to be pivotable in a vertical direction about the axis of the horizontal slot as well as being slidable lengthwise of the horizontal slot, whereby different spring units can be actuated by different combinations of movements of the lever.

14 Claims, 2 Drawing Sheets

Fig. 1
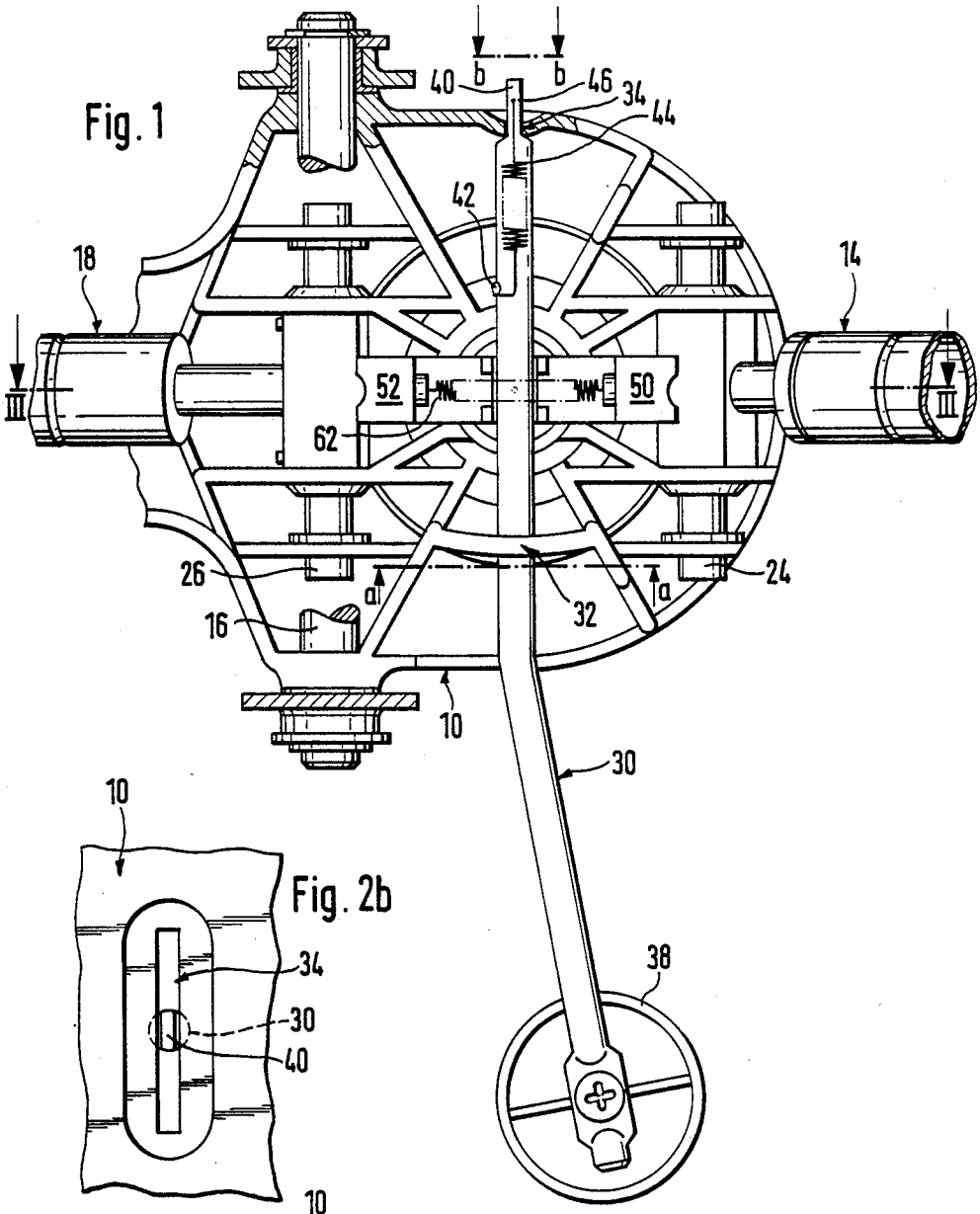
Fig. 2b
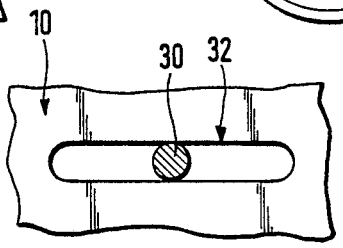
Fig. 2a

SEAT ADJUSTMENT APPARATUS

BACKGROUND OF THE INVENTION

Seats such as more particularly office chairs which comprise a seat portion and a backrest portion frequently have at least two gas spring units for performing at least two different functions such as adjusting the angle of inclination of the seat portion and adjusting the angle of inclination of the backrest portion, to adapt the seat to the respective requirements of the person using same.

In one form of such a seat, as disclosed in European patent No. 0 022 933, the seat comprises a common operating lever for operating the two gas spring units to provide for the respective adjustment functions thereof. In broad terms, the operating lever has a knob or handle at one end, while at its other end, it is mounted pivotably about a vetical axis, so as to move in an at least generally horizontal direction. At a further location spaced from the end remote from the handle end of the lever, the lever is mounted slidably in a horizontal guide slot. The mounting arrangement provides a common pivot point for both horizontal pivotal movement and vertical pivotal movement of the operating lever, and the operating lever can thus describe any pattern or figure in the plane perpendicular to its longitudinal axis, if it is moved with a horizontal pivotal movement and also a vertical pivotal movement, out of its original position. That structure therefore requires an additional guide means for guiding the lever, in the form of a control gate configuration, so that only the pivotal movements required for actuation of the individual gas springs can be performed, thus ensuring that the lever is operated in a well-defined and unambiguous manner.

German laid-open application (DE-OS) No. 33 25 798 discloses a gas spring unit which is designed in particular for adjusting the backrest portion of a chair or the like, which has an operating lever. The operating lever has a handle or gripping portion at one end while at the opposite end it is guided in a slot opening, displaceably both vertically and horizontally, while at a location spaced therefrom, it is mounted slidably in a vertical guide slot and pivotably horizontally about the longitudinal axis of the vertical guide slot.

SUMMARY OF THE INVENTION

An object of the present invention is to provide a seat which is of a simple construction while affording the options of multiple adjustability thereof.

Another object of the invention is to provide a seat such as an office chair having gas spring units operated jointly by a single operating lever which can be operated in a simple manner.

A further object of the invention is to provide a seat having gas spring units operated by a single operating lever which is guided by guide configurations of a simple nature.

Still a further object of the invention is to provide an office chair having a plurality of gas spring units for performing different functions, which can be operated by a single lever involving easy sliding and pivotal movements thereof.

In accordance with the principles of the present invention, these and other objects are achieved by a seat such as an office chair having at least first and second gas spring units for performing at least first and second different functions, such as adjusting the angle of inclination of a backrest portion and adjusting the angle of inclination of a seat portion of the chair. A common operating lever for operating the gas spring units to provide for such adjustments is mounted pivotably in a horizontal direction about a substantially vertical axis at the end of the lever which is remote from the gripping end thereof, and is also mounted slidably in a horizontal guide slot, at a location spaced from the first-mentioned end. The actuating lever is additionally mounted slidably in a vertical guide slot, at the first-mentioned end, and is additionally mounted in the horizontal guide slot pivotably about the longitudinal axis thereof, in a substantially vertical direction.

The configuration according to the invention as outlined above means that it is possible to eliminate any additional guide gate configuration for guiding the operating lever as the construction according to the invention provides both for a guiding action in the event of vertical pivotal movement of the lever and also a guiding action in the event of horizontal pivotal movement of the lever. Furthermore, even when the operating lever is in a horizontally deflected position from its original position, the lever can still be pivoted vertically and likewise, when it is in a vertically displaced position, the lever can be pivoted horizontally. Such a combination of movements and freedom of choice in respect thereof is not achieved when using a guide gate configuration as referred to above.

Further objects, features and advantages of the present invention will be apparent from the following description of a preferred embodiment thereof.

BRIEF DESCRIPTION OF THE DRAWINGS

FIG. 1 is a plan view of an adjusting mechanism for a seat according to the present invention, FIGS. 2*a* and 2*b* are views on lines a—a and b—b respectively in FIG. 1.

DESCRIPTION OF A PREFERRED EMBODIMENT

Figure 3:
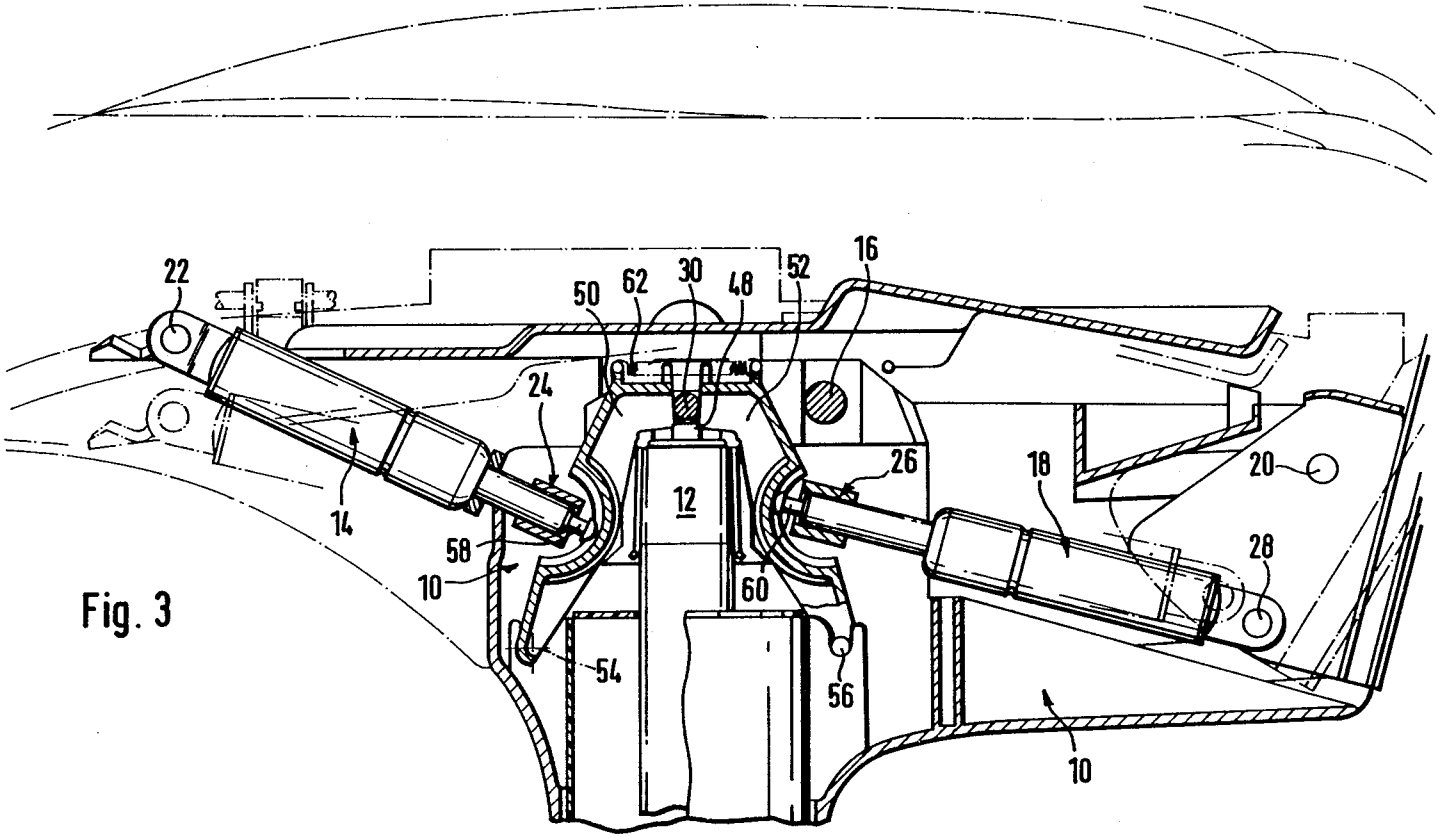
FIG. 3 is a view in longitudinal section through the middle of the FIG. 1 construction, viewing in the direction indicated by the arrow 3.

Referring generally to the drawings, it will be appreciated that shown therein is essentially the support and adjusting mechanism of an office chair, without illustrating other conventional components of such a chair such as a seat plate portion and a backrest portion, and the general structure for supporting same.

Referring firstly now to FIGS. 1 and 3, a seat carrier assembly 10 is connected to the base of the seat (not shown) by way of a gas spring unit 12 which is operable to adjust the height of the seat, which may be for example an office chair. A further gas spring unit 14 is provided for adjusting the angle of inclination of the seat portion (not shown), being operatively connected between a part of the seat portion and seat carrier assembly 10, as can be clearly seen from the drawings. The axis of rotation about which the seat portion is pivotable is diagrammatically indicated by reference numeral 16 in both FIGS. 1 and 3, and the shaft or spindle providing the pivot axis extends through the seat carrier assembly 10. A further gas spring unit 18 is provided for adjustment of the angle of inclination of the backrest portion (also not shown), and is operatively disposed between the seat carrier assembly 10 and the backrest portion which in turn is mounted pivotably about an axis of rotation as indicated at 20, comprising for example a suitable shaft or spindle extending through the seat carrier assembly 10. The pivotal mounting points of the respective gas spring units 14 and 18 are indicated at 22, 24 and 26, 28 respectively, as shown in FIG. 3. The manner in which the gas spring units 14 and 18 are fixed and mounted in position is generally conventional and will therefore not be described in greater detail herein.

For the purposes of releasing and subsequently locking the individual gas springs 12, 14 and 18 by actuating the valve control members or rods thereof, the illustrated seat structure has an operating lever 30 which is common to all the gas spring units 12, 14 and 18. Looking at FIG. 1, it will be seen that the lever 30 is of a generally elongate configuration, with a slight bend at a position intermediate the ends thereof, while a handle or gripping member 38 is fixed to one end of the lever while reference numeral 40 denotes the other end of the lever.

Referring now also to FIGS. 2*a* and 2*b*, the lever 30 is mounted at a position intermediate its length in a horizontal guide means in the form of a guide slot 32, in such a way as to be pivotable in an at least substantially vertical direction about the longitudinal axis of the guide slot 32, while at its end 40 it is mounted in a vertical guide means in the form of a guide slot 34 in such a way as to be pivotable in a horizontal direction about the longitudinal axis of the guide slot 34. A general view of the mounting configuration can best be seen from FIG. 1 while FIG. 2*a* shows the horizontal guide slot 32 in the carrier assembly 10 and FIG. 2*b* shows the vertical guide slot 34 which is also provided in the carrier assembly 10.

Looking still at FIG. 1 and also FIG. 2*b*, the end 40 of the lever 30 which is of a generally round cross-section is flattened thereat to provide a plate-like or flattened projection portion of generally elongate rectangular cross-section, as can best be seen from FIG. 2*b*. That portion is thus guided in the slot 34.

A tension spring 44 which is operatively disposed between the lever 30 at 42 and the carrier assembly 10 at 46 secures the operating lever 30 to the carrier assembly 10, and is operative to urge the lever in the downward direction in the plane of the drawing of FIG. 1.

When the lever 30 is pulled with its handle end 38 upwardly out of the plane of the drawing of FIG. 1, that is to say, with the handle end 38 moving towards the viewer of FIG. 1, the lever 30 pivots about the upper edge of the slot forming the horizontal guide means 32, as shown in FIG. 2*a*, so that the portion of the lever which is between the horizontal guide slot 32 and the vertical guide slot 34 moves downwardly with a pivotal movement, thus engaging and actuating a valve rod 48 which is shown in FIG. 3, to provide for adjustment in respect of the height of the chair, by releasing the gas spring unit 12. When the gas spring unit 12 has been released, the chair can be adjusted to the required height of its seat portion and the lever can then be released again to re-lock the gas spring unit 12 at the desired adjusted position.

During the pivotal movement of the lever 30 about the edge of the horizontal guide slot 32, the flattened end portion at the end 40 of the lever 30 is displaced with a sliding movement in the vertical guide slot 34, thereby ensuring a positive guide action in the vertical plane.

For the purposes of releasing the gas spring unit 14 or the gas spring unit 18, the operating lever 30 has to be pivoted in a horizontal plane either towards the gas spring unit 14 or towards the gas spring unit 18, about the vertical axis which is defined by the horizontal guide slot 34. In that mode of operation, guidance for the lever in the horizontal plane is provided by the horizontal guide slot 32. When the lever 30 is pivoted in that way towards a respective one of the gas spring units 14 or 18, it firstly presses against an associated pivot arm 50 or 52 respectively; the arms 50 and 52 can be clearly seen in side view in FIG. 3 and are mounted pivotably on the carrier assembly 10 about respective pivot axes indicated at 54 and 56. Each of the arms 50 and 52 acts on the respective valve rod 58 and 60 of the respective gas spring units 14 and 18, thereby to release the appropriate gas spring unit, depending on the direction of movement of the lever 30. The arms 50 and 52, between which the lever 30 extends transversely of the carrier assembly 10, are urged towards each other by means of a tension coil spring 62 which engages the arms 50 and 52 at the ends thereof which are remote from the pivot mounting axes 54 and 56 thereof. The spring 62 can be clearly seen from FIGS. 1 and 3.

It will be seen from the foregoing description and also the accompanying drawings that it is possible simultaneously to release the gas spring unit 12 by a substantially vertical pivotal movement of the lever 30 to operate the valve rod 48 of the gas spring unit 12, and also one of the gas spring units 14 or 18 by a corresponding pivotal movement in an at least substantially horizontal plane. The mounting configurations which mount the lever 30 in the carrier assembly 10 permit that combination of adjustment movements.

It should also be noted that the valve rods 58 and 60 of the gas spring units 14 and 18 are guided on respective circular paths of movement, the centre points of which are formed by the pivot mounting axes 24 and 26 respectively, as can best be seen from FIG. 3. The portions of the arms 50 and 52 which thus co-operate with the gas spring units 14 and 18 are of a corresponding curved configuration. That ensures that, in any position of inclination of the seat portion or the backrest of the illustrated chair construction, the respective valve rod 58 or 60 is actually not in an actuated condition, when the lever 30 is in its neutral position.

It will be noted that, because the horizontal guide slot 32 is spaced from the vertical guide slot 34 and the lever 30 is pivotable about the respective pivot axes which thus extend parallel to the longitudinal axis of the respective guide slots 32 and 34, there is no need to provide an additional guide gate configuration for guiding the lever 30 in its operating movements.

Furthermore, the construction as described above and illustrated means that, when the operating lever 30 is lifted at its handle end 38, the end 40 remote therefrom moves downwardly to release the gas spring unit 12 which is positioned between the horizontal guide slot 32 and the vertical guide slot 34 of the lever 30, to provide for adjustment of the height of the seat. Lifting the lever to release the gas spring unit 12 is ergonomically more satisfactory and convenient than having to depress the operating lever to release the gas spring unit 12 for adjustment purposes.

It will be appreciated that the above-described embodiment of the invention has been set forth solely by way of example of the principles thereof and that various modifications and alterations may be made therein without thereby departing from the spirit and scope of the invention.

What is claimed is:

1. Seat adjustment apparatus disposed beneath a seat for adjusting the position of said seat comprising a first gas spring unit for adjusting said seat in a first manner on actuation thereof, a second gas spring unit for adjusting said seat in a second manner upon actuation thereof, common operating lever means including a first end and a second end, said second end of said common operating lever means including gripping means, first mounting means mounting said common operating lever means at a first location thereon and second mounting means mounting said common operating lever means at a second location thereon, said common operating lever means having a first portion and a second portion, said first portion of said common operating lever means being slidably displaceable in said first mounting means while said second portion of said common operating lever means pivots about said second mounting means, and said second portion of said common operating lever means being slidably displaceable in said second mounting means while said first portion of said common operating lever means pivots about said first mounting means whereby said first gas spring unit may be actuated in response to said slidable displacement of said common operating lever means in said first mounting means and said second gas spring unit may be actuated in response to said slidable displacement of said common operating lever means in said second mounting means.

2. The seat adjustment apparatus of claim 1 wherein said first location comprises said first end of said common operating lever means, and said second location comprises a point intermediate of said first and second ends of said common operating lever means.

3. The seat adjustment apparatus of claim 2 wherein said first mounting means comprises a first guide slot defining a first plane and said second mounting means comprises a second guide slot extending into said first plane.

4. The seat adjustment apparatus of claim 3 wherein said common operating lever means includes a flattened portion at said first location whereby said flattened portion can be slidably displaced along said first guide slot.

5. The seat adjustment apparatus of claim 1 including spring means for holding said common operating lever means in a predetermined position.

6. The seat adjustment apparatus of claim 5 wherein said spring means comprises a tension spring interconnecting said common operating lever means and one of said first and second mounting means.

7. Seat adjustment apparatus disposed beneath a seat comprising a first gas spring unit for adjusting said seat in a first manner on actuation thereof, a second gas spring unit for adjusting said seat in a second manner upon actuation thereof, a third gas spring unit for adjusting said seat in a third manner upon actuation thereof, common operating lever means including a first end and a second end, said second end of said common operating lever means including gripping means, first mounting means mounting said common operating lever means at a first location thereon, and second mounting means mounting said common operating lever means at a second location thereon, said common operating lever means having a first portion and a second portion, said first portion of said common operating lever means being slidably displaceable in said first mounting means while said second portion of said common operating lever means pivots about said second mounting means, said second portion of said common operating lever means being slidably displaceable in said second mounting means while said first portion of said common operating lever means pivots about said first mounting means whereby said first, second and third gas spring units may be actuated in response to said slidable displacement of said common operating lever means.

8. The seat adjustment apparatus of claim 7 wherein said first gas spring unit may be actuated by displacement of said common operating lever means in a first direction, said second gas spring unit may be actuated by displacement of said common operating lever means in a second direction, and said third gas spring unit may be actuated by displacement of said common operating means in a third direction.

9. The seat adjustment apparatus of claim 8 wherein said second and third directions lie in a common plane.

10. The seat adjustment apparatus of claim 8 wherein said first location comprises said first end of said common operating lever means, and said second location comprises a point intermediate of said first and second ends of said common operating lever means.

11. The seat adjustment apparatus of claim 10 wherein said first mounting means comprises a first guide slot defining a first plain and said second mounting means comprises a second guide slot extending into said first plane.

12. The seat adjustment apparatus of claim 11 wherein said common operating lever means includes a flattened portion at said first location whereby said flattened portion can be slidably displaced along said first guide slot.

13. The seat adjustment apparatus of claim 7 including spring means for holding said common operating lever means in a predetermined position.

14. The seat adjustment apparatus of claim 13 wherein said spring means comprises a tension spring interconnecting said common operating lever means and one of said first and second mounting means.

* * * * *